United States Patent [19]

Ishihara

[11] Patent Number: 4,860,677

[45] Date of Patent: Aug. 29, 1989

[54] CLUTCH REVERSING ROLL FEED FOR A SEWING MACHINE

[75] Inventor: Yoshihiro Ishihara, Shimane, Japan

[73] Assignees: Juki Corporation, Tokyo; Nakajima Seisakusho Company, Shimane, both of Japan

[21] Appl. No.: 201,478

[22] Filed: Jun. 1, 1988

[51] Int. Cl.[4] ..... D05B 27/14

[52] U.S. Cl. ..... 112/318; 112/317; 192/51

[58] Field of Search ..... 112/318, 322, 317; 192/51

[56] References Cited

U.S. PATENT DOCUMENTS 3,104,639 9/1963 Reeber .
3,141,428 7/1964 Reeber et al. .
3,285,211 11/1966 Hayes et al. ..... 112/322
4,643,118 2/1987 Bungert et al. ..... 112/318

FOREIGN PATENT DOCUMENTS 62-281992 12/1987 Japan .

*Primary Examiner*—Andrew M. Falik
*Attorney, Agent, or Firm*—Fitch, Even, Tabin & Flannery

[57] ABSTRACT

A sewing machine with a pair of feed wheels which clamp a workpiece therebetween to transport the workpiece, the sewing machine comprising first and second feed shafts each of which have a clutch portion at an end thereof in opposition to each other and a group of gears disposed between these feed shafts for rotating the second shaft in the direction reverse to the rotational direction of the first shaft. The direction of transportation of the workpiece is changed by means of a clutch having a portion which selectively contacts the clutch portion of either the first or second feed wheel.

4 Claims, 9 Drawing Sheets

CLUTCH REVERSING ROLL FEED FOR A SEWING MACHINE

BACKGROUND OF THE INVENTION

The present invention relates to a workpiece feeding apparatus for a sewing machine used for leather products or the like wherein a workpiece is fed by wheels.

It is a conventional practice in workpiece feeding apparatus for sewing machines to hold a workpiece between wheels disposed at upper and lower positions so as to face each other for the workpiece to be fed out by driving the lower wheel. However, none of those workpiece feeding apparatus has been provided with anything like a workpiece reverse feeding function, in other words, the function of allowing a lower wheel to be rotated in the reverse direction. This is because the one-way clutch which is used to intermittently rotate the lower wheel only has the function of rotating the lower wheel in the forward direction and because it is not adapted to function in the reverse direction.

In a case where the reverse feeding described above is not available, a workpiece has to be turned around when reverse stitching or the like is desired, the user thus being forced to perform troublesome work. To deal with this problem, it is known that a feed dog used in a conventional sewing machine is employed in order to provide both forward and reverse feeding to a workpiece.

However, such a feed dog is designed to perform four motions simultaneously, that is, to and fro motions, and up and down motions, and to feed a workpiece out by engaging the same when it is raised. Therefore, in the case of a leather product workpiece, it is most likely that the surface of the leather product is scratched when it is fed out by the feed dog, which involves the problem that the product value is likely to deteriorate to a great extent.

It is an object of the present invention to provide a workpiece feeding apparatus for feeding a workpiece in forward and reverse directions by means of wheels, thus eliminating any risk of scratching the surface of a workpiece, even if the workpiece is a leather product.

SUMMARY OF THE INVENTION

The present invention is directed to a workpiece feeding apparatus which comprises oscillating members adapted to oscillate through the action of a shaft which rotates with the rotation of a drive shaft, one-way clutches adapted to transform the oscillating motions of the oscillating members into the intermittent rotation of a first feed shaft, and a second feed shaft adapted to rotate in the direction reverse to the rotational direction of the first feed shaft by virtue of rotational motion-transmission mechanisms, whereby rotation of either of these feed shafts is transmitted to a lower wheel by means of a clutch.

In the present invention, both of the shafts are designed to rotate in synchronism with the rotation of the drive shaft, but in the reverse direction relative to each other. As the need arises, a clutch disposed between the shafts is brought into contact with either of the shafts, the rotation of the shaft with which the clutch is in contact thus being transmitted to the lower wheel, which in turn is actuated to feed a workpiece intermittently in synchronism with the vertical motion of a needle.

DESCRIPTION OF THE PREFERRED EMBODIMENT

Figure 1:
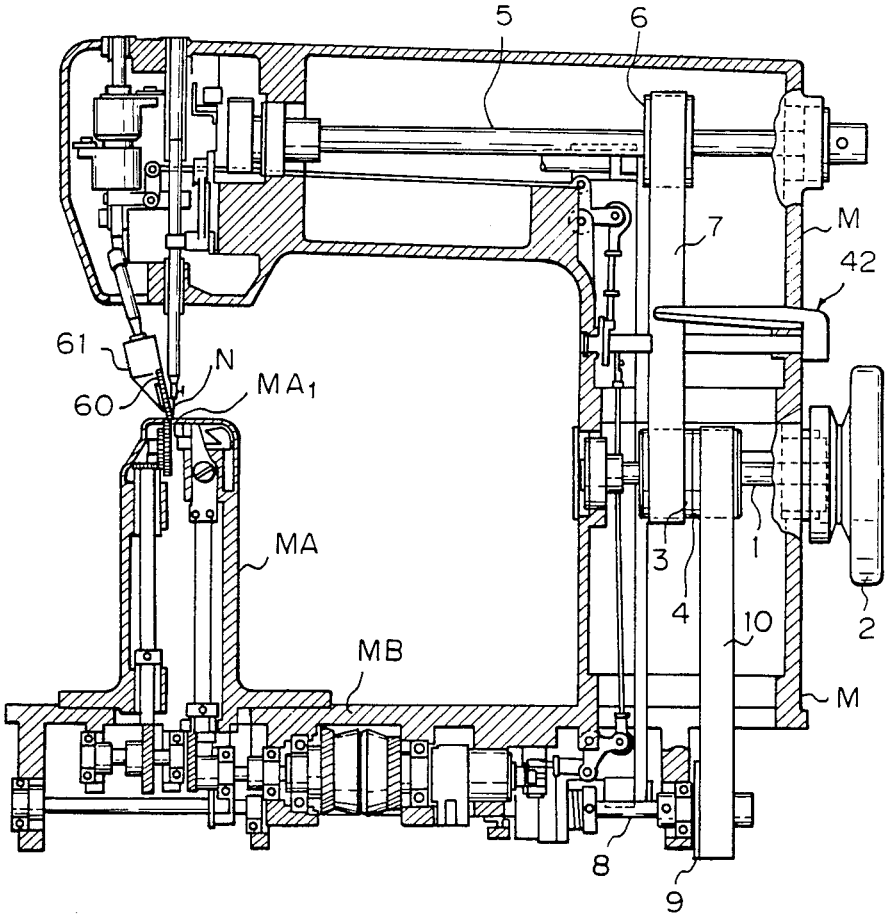
FIG. 1 is a vertical sectional front view of a sewing machine illustrated herein as one embodiment of the present invention.

The preferred embodiment of the invention will now be described with reference to the accompanying drawings. The same numeral references are assigned to the same components throughout the drawings.

In the figures, reference numeral 1 denotes an intermediate shaft as a drive shaft. Provided at one end thereof is a flywheel 2 connected with a drive source, which is not shown, via a drive belt, and sprockets 3 and 4 are secured on the central portion of the drive shaft 1. The sprocket 3 is connected via a toothed belt 7 with a sprocket 6 which is secured on an arm shaft 5, the sprocket 4 being connected via a toothed belt 10 with a sprocket 9 which is secured on a bottom shaft (shaft body) 8 at one end thereof. With such a construction, the arm shaft 5 and the bottom shaft 8 are designed to rotate as the intermediate shaft 1 rotates, and one rotation of the arm shaft 5 generates one stroke of a needle N (a descending and ascending motion). When descending, the needle N is accepted into a needle hole MAI provided in a work support MA which is provided on the bed of a sewing machine MB in such a manner as to project therefrom.

Figure 2:
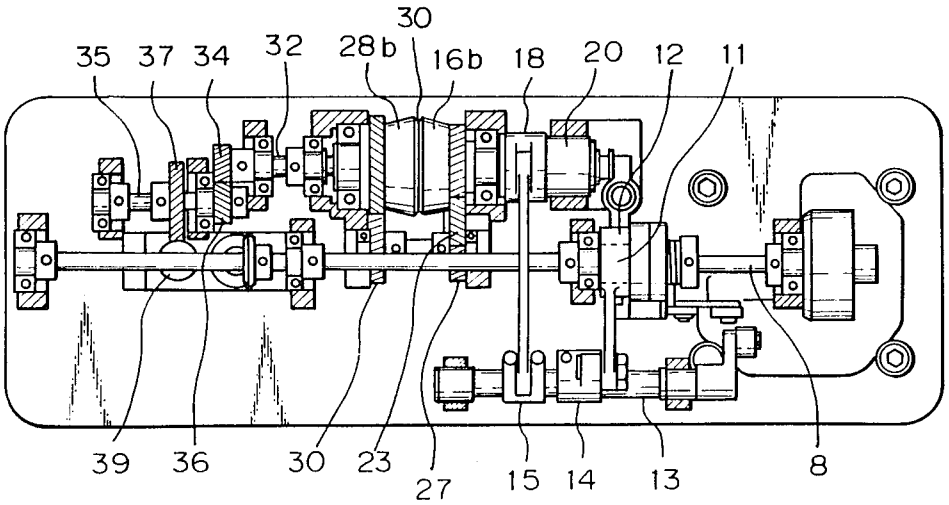
FIG. 2 is a bottom view of the same sewing machine.
Figure 5:
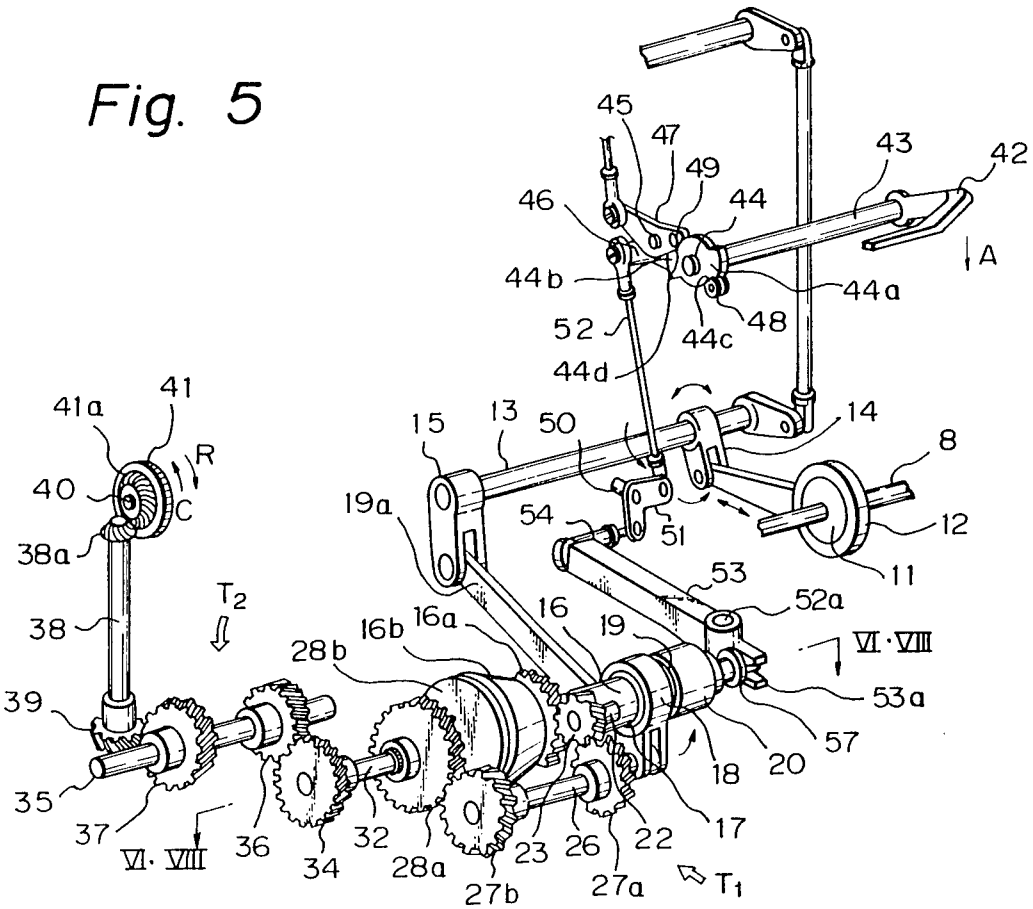
FIG. 5 is an exploded perspective view showing the embodiment of the present invention.

As shown in FIGS. 2 and 5, an eccentric cam 11 is secured on a certain position of the bottom shaft 8. A feed rod 12 is rotatably fitted over the outer peripheral portion of the eccentric cam 11 at one end thereof and at the other end it is rotatably connected to one end of an arm 14 which is secured at a certain position of an oscillating shaft 13, the oscillating shaft 13 thus being caused to rotate through a predetermined angle in clockwise and counterclockwise directions by the arm 14 which oscillates as the bottom shaft 8 rotates. Provided and secured at one end of the oscillating shaft 13 is an arm 15, which is connected via a link 19*a* with an arm body 18 as an oscillating member provided at a certain position of a feed shaft 16.

The arm body 18 is mounted on the feed shaft 16 via a one-way clutch 17, which allows the feed shaft 16 to rotate only when the arm body 18 rotates clockwise (refer to FIG. 5).

Figure 6:
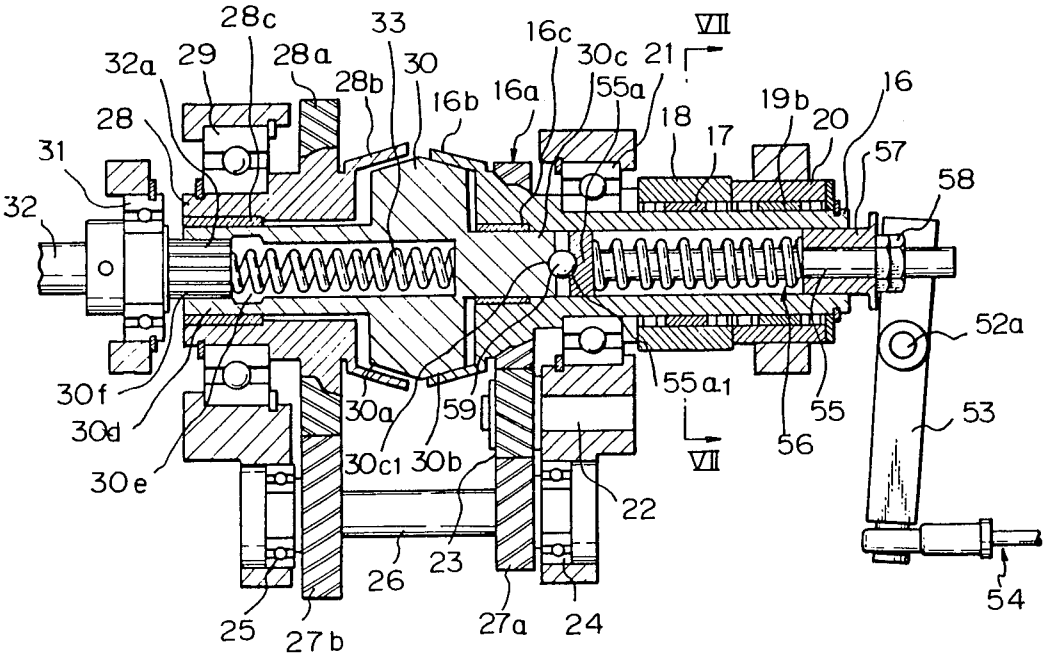
FIG. 6 is a sectional view taken along the line VI—VI of FIG. 5 and showing the forward feeding state.
Figure 7:
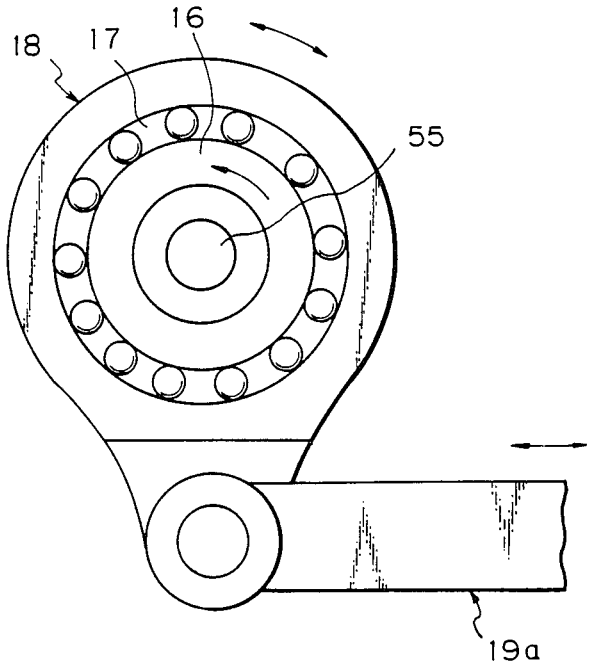
FIG. 7 is a cross sectional view taken along the line VII—VII of FIG. 6.

The feed shaft 16 has, as shown in FIG. 6, a hollow configuration and is supported on a sewing machine main body M via a bearing 21 and a bushing 20, the latter being mounted over the circumference of a one-way clutch 19*b*.

This one-way clutch 19*b* is designed to allow rotation in the direction opposite to that allowed by the one-way clutch 17, thus preventing the feed shaft 16 from rotating in the opposite direction while the arm body 18 is being caused to oscillate. Formed on a certain portion of the feed shaft 16 is a gear 16*a*, which is adapted to engage with an intermediate gear 23 fitted over a shaft 22 which is supported on the sewing machine main body M. Respective gears 27*a* and 27*b* are secured at certain positions of a shaft 26 which is rotatably supported by bearings 24 and 25, and the intermediate gear 23 is adapted to engage one of these gears, 27*a*.

A feed reversing shaft 28 having a hollow configuration is provided along the axis of the feed shaft 16 and supported there on the sewing machine main body M via a bearing 29. Formed at a certain position of the feed reversing shaft 28 is a gear 28*a*, which is adapted to engage the gear 27*b* secured on the shaft 26. Thus, the gears 16*a*, 23, 27*a*, 27*b* and 28*a* together with the shafts 22 and 26 operate as a first rotational motion-transmission mechanism T1.

In addition, the feed shafts 16 and 28 are formed with flared clutch portions 16*b* and 28*b* at their opposed ends. A clutch 30 having shaft portions 30*c*, 30*d* and clutch portions 30*a* and 30*b* corresponding to the clutch portions 28*b* and 16*b*, respectively, is provided between the feed shafts 16 and 28 in such a manner that the shaft portions 30*c* and 30*d* of the clutch 30 are rotatably supported via bushings 28*c* and 16*c* inside the shafts 28 and 16, respectively.

A hole 30*e* receiving a spring 33 is formed inside the shaft portion 30*c* of the clutch 30 in such a manner as to extend axially, and splines 30*f* are formed on the inner surface of the end portion of the hole 30*e*. Formed in one end of a first gear shaft 32 are splines 32*a* for engagement with the splines 30*f*. A presser spring 33 is installed in the hole 30*e* with one end thereof in contact with the end face of the first gear shaft 32.

Secured at the other end of the first gear shaft 32 is a gear 34 (FIGS. 2 and 5) which engages with a gear 36 secured on a second gear shaft 35. Rotational motion transmitted to the gear 36 is in turn transmitted to a third gear shaft 38 via another gear 37 secured on the second gear shaft 35 and a gear 39 secured at one end of the third gear shaft 38, a bevel gear 38*a* thus being caused to rotate. This bevel gear 38*a* is adapted to engage with a gear 41*a* formed in the side of a lower wheel 41, the lower wheel 41 thus being caused to rotate on an axle 40 according to the rotational direction of the bevel gear 38*a*. Thus, the gears 34, 36, 37, 38*a* and 39 and the shafts 32, 35 and 38 operate as a second rotational motion-transmission mechanism T2.

Reference numeral 42 is a reverse lever for use in reverse stiching, which is secured at one end of a shaft 43 supported by the sewing machine main body M. A cam having two projections 44*a* and 44*b* is secured on the shaft 43. Two curved links 46 and 47 are connected to the cam 44 in such a manner that they can rotate in forward and reverse directions on a link axle 45. Provided at one end of the respective links 46 and 47 are rollers 48 and 49 which can rotate in both directions. One end of a rod 52 is provided to the other end of the link 46. The other end of the rod 52 is provided to one end of a "dog-leg" shaped link 51 which is supported on the sewing machine main body M via a shaft 50 so as to rotate thereon in both directions. The link 51 is connected to a lever 53 via a rod 54 at the other end thereof.

Figure 8:
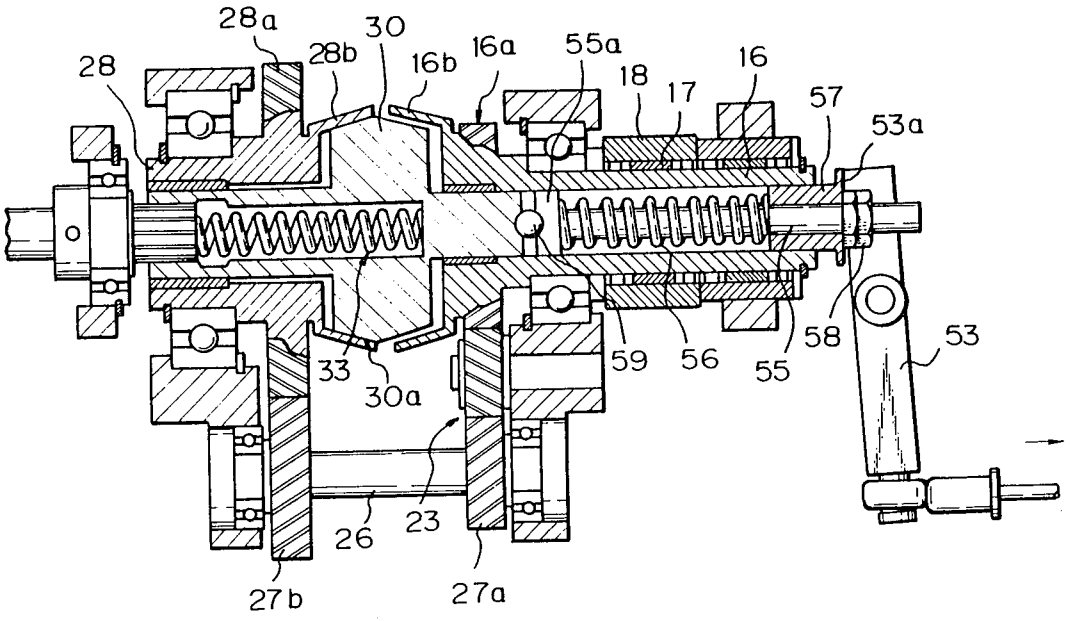
FIG. 8 is a sectional view taken along the line VIII—VIII of FIG. 5 and showing the reverse feeding state.

A shaft 55 having a collar portion 55*a* is installed in the feed shaft 16, with a return spring 56 and a thrust block 57 fitted thereover, as shown in FIGS. 6 and 8. The thrust block 57 is locked by a nut 58 so that the return spring 56 can be retained therein as it is pressed. Concave portions 30*cl* and 55*al* having the same curvature are respectively formed in the end face of the shaft portion 30*c* of the clutch 30 and the end face of the collar portion 55*a* of the shaft 55 allowing a spherical body 59 to be fitted therein. The other end of the thrust block 57 is adapted to contact one end of the shaft 53.

Referring again to FIG. 1, reference numeral 60 is an upper wheel mounted at one end of a support arm 61 in such a manner as to be opposite to the lower wheel and to rotate in forward and reverse directions, thus being designed to press the upper surface of the workpiece against the lower wheel.

OPERATION OF THE PREFERRED EMBODIMENT

Operation of the preferred embodiment of the present invention will now be described on the basis of the construction described above.

The forward feeding of a workpiece will first be described.

When feeding a workpiece forward, the reverse lever 42 is located at an upper position, the rollers 48 and 49 of the respective links 46 and 47 thereby being caused to locate at the channel portions 44*c* and 44*d* of the cam 44. In this condition, the biassing force produced by the presser spring 33 in the clutch 30 (refer to FIG. 6) overcomes that produced by the return spring 56 in the feed shaft 16, which causes the clutch 30 to move toward the feed shaft 16 side, the clutch portion 30*b* of the clutch 30 thus being brought into contact with the clutch portion 16*b* of the feed shaft 16, as shown in FIG. 6. This produces space between the feed reversing shaft 28 and the clutch 30. Under this condition, when the intermediate shaft 1 rotates, the arm shaft 5 and the bottom shaft 8 are caused to rotate in synchronism therewith. Rotation of the bottom shaft 8 causes the eccentric cam 11 to rotate, the feed rod 12 thereby being caused to oscillate to and fro. This oscillating motion is then transmitted to the oscillating shaft 13 via the arm 14 and further to the arm body 18 via the arm 15 and the link 19*a*, the arm body 18 thus being caused to oscillate through a predetermined angle. This rotation of the arm body 18 causes the one-way clutch 17 to intermittently rotate the feed shaft 16. In other words, the feed shaft 16 is designed to rotate only when the arm body 18 rotates in a certain direction. When the feed shaft 16 rotates, the clutch 30 also rotates due to the fact that they are in contact with each other. Then, the rotational motion of the clutch 30 is transmitted to the first gear shaft 32, the rotational motion of the first gear shaft 32 in turn being transmitted to the second gear shaft 35 via the gears 34 and 36 and further to the third gear shaft 38 via gears 37 and 39. Thus, the rotational motion transmitted to the third gear shaft 38 causes the bevel gear 38*a* to rotate, which in turn causes the lower wheel 41 to rotate forward (in the direction of the arrow C shown in a solid line in FIG. 5), thus feeding forward the workpiece on the work support MA. As is clear from the above, the lower wheel rotates as the bottom shaft 8 rotates, and as a result, it rotates in synchronism with an ascending and descending motion of the needle N.

Figure 9:
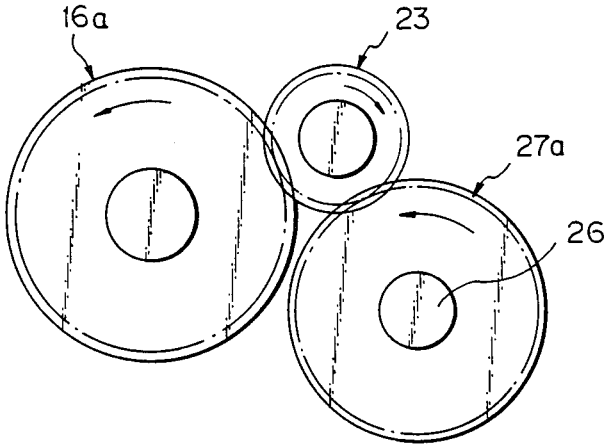
FIG. 9 is an end view as viewed from the right hand side illustrating the first rotational motion-transmission mechanism shown in FIGS. 6 and 8.
Figure 10:
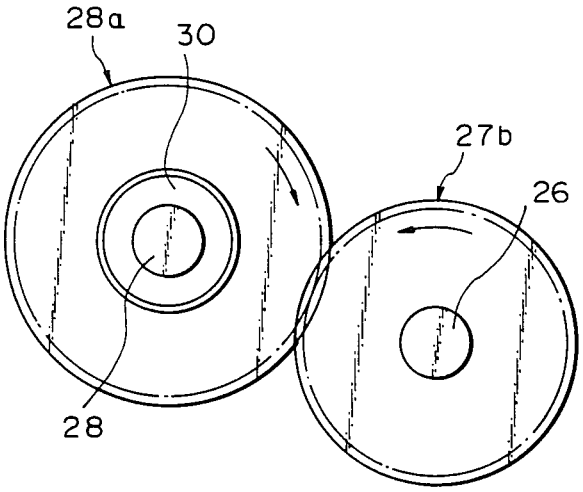
FIG. 10 is an end view as viewed from the left hand side also illustrating the first rotational motion-transmission mechanism.

As shown in FIGS. 9 and 10, rotational motion of the feed shaft 16 is transmitted from the intermediate gear 23 to the feed reversing shaft 28 via the gears 27*a*, 27*b* and 28*a*. However, since the feed reversing shaft 28 is away from the clutch 30, the rotational motion transmitted to the shaft 28 has no effect on the clutch 30.

Next the reverse feeding of a workpiece will be described hereinbelow.

When effectuating the reverse feeding, the reverse lever 42 is pressed down, whereby the cam 44 is caused to rotate via the shaft 43, which in turn causes the roller 48 to mount on the projection 44*a*. This causes the link 46 to rotate on the link axle 45, the rod 52 thus being pulled up. This rotates the link 51 connected to the shaft 52, the rotation of the link 51 then causing the lever 53 to rotate via the rod 54, whereby the thrust block 57 is forced into the inside of the feed shaft 16 against the action of the elastic force of the return spring 56, as shown in FIG. 8. In this condition, the biassing force produced by the return spring 56 and acting on the collar portion 55*a* overcomes the biassing force of the clutch 30 produced by the presser spring 33, whereupon the clutch 30 starts to separate from the feed shaft 16 and is biassed toward the feed reversing shaft 28 via the spherical body 59. This causes the clutch portion 28*b* of the feed reversing shaft 28 to come into contact with the clutch portion 30*a* of the clutch 30. Under this condition, when the intermediate shaft 1 rotates, the feed shaft 16 is intermittently rotated by the one-way clutch 17, as previously described. When the feed shaft 16 rotates, the shaft 26 rotates in the same rotational direction as that of the feed shaft 16 via the intermediate gear 23 and the gear 27*a*. As shown in FIG. 10, rotational motion of the shaft 26 is transmitted to the feed reversing shaft 28 via the gears 27*b* and 28*a*, the feed reversing shaft 28 being caused to rotate in the direction reverse to the rotational direction of the feed shaft 16, whereby the clutch 30 and the first gear shaft 32 which are both in contact with the feed reversing shaft 28 are also caused to rotate in the direction reverse to the rotational direction of the feed shaft 16. As previously described, this rotational motion of the first gear shaft 32 is transmitted to the third gear shaft 38 via the gears 34 and 36, the second gear 35 and the gears 37 and 39, the bevel gear 38*a* thus being caused to rotate. However, since the rotation of the bevel gear 38*a* in this condition is reverse to the rotation thereof at the time of the forward feeding, the lower wheel 41 is caused to rotate in the reverse feeding direction (in the direction of the arrow R shown by a chain line in FIG. 5), whereby a workpiece is fed in the reverse direction. It is needless to say that the lower wheel 41 rotates intermittently in synchronism with an ascending and descending motion of the needle N, as is the case with forward feeding.

Figure 3:
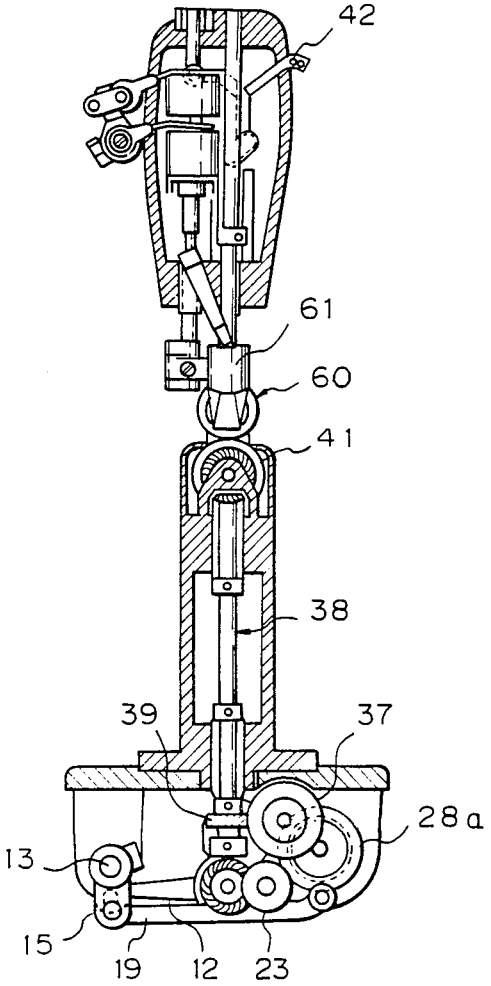
FIG. 3 is a vertical sectional end view of the same sewing machine as viewed from the left hand side.
Figure 4:
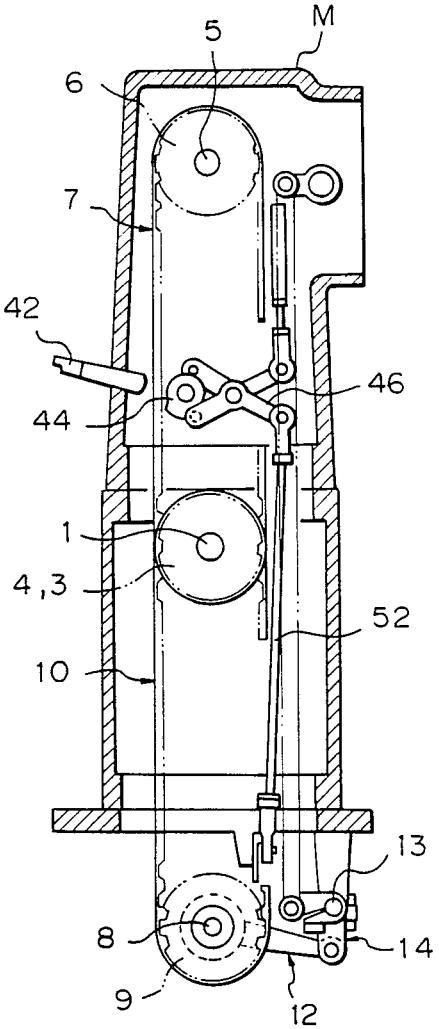
FIG. 4 is a vertical sectional end view of the same sewing machine as viewed from the right hand side.

In this embodiment, the lower wheel 41 and the upper wheel 60 (FIGS. 1 and 3) are respectively designed to serve as a drive wheel and a non-drive wheel, the latter for pressing down the upper surface of a workpiece. However, it is also possible to provide the upper wheel 60 with a drive mechanism like one provided for the lower wheel 41, and, in contrast to the above embodiment, even if the upper wheel 60 is made to act as a drive wheel with the lower wheel 41 acting as a non-drive wheel, the same operational effect as that of the above embodiment would be attainable. Furthermore, if both wheels are designed to act as a drive wheel, a more desirable feeding operation will be attained.

Although the conical friction clutch is employed to contact and separating from the first and second feed shafts in the above embodiment, a claw clutch may instead be employed to perform the above described function wherein gears are utilized to contact and separate from the shafts.

As is described above, with this invention, a workpiece can be intermittently fed in forward and reverse directions, and with such a feeding operation even if the workpiece takes the form of a leather product, any risk of scratches can be eliminated. Thus, an advantage of the present invention is that desirable feeding of a workpiece can be attained.

What is claimed is:

1. A workpiece feeding apparatus for a sewing machine wherein a workpiece is transported by a pair of feed wheels which clamp the workpiece therebetween, said workpiece feeding apparatus comprising:

a feed shaft having a first clutch portion provided at one end thereof adapted to intermittently rotate in a certain direction in synchronism with the movement of a needle;

a feed reversing shaft having a second clutch portion provided at one end thereof in opposition to said first clutch portion;

a first transmission means disposed between said feed shaft and said feed reversing shaft for rotating said feed reversing shaft in the direction reverse to the rotational direction of said feed shaft;

a clutch means having clutch portions adapted to selectively contact either said first or second clutch portions which rotate in opposite directions in order to define the direction of transportation of said workpiece; and a second transmission means disposed between said clutch means and said feed wheels for transmitting the rotational direction of the clutch means to said feed wheels.

2. An apparatus according to claim 1, wherein said first transmission means is composed of a group of gears.

3. An apparatus according to claim 1, wherein said second transmission means is composed of a group of gears.

4. An apparatus according to claim 2, wherein said second transmission means is composed of a group of gears.

* * * * *

UNITED STATES PATENT AND TRADEMARK OFFICE

CERTIFICATE OF CORRECTION

PATENT NO. : 4,860,677

DATED : August 29, 1989

INVENTOR(S) : Yoshihiro Ishihara

It is certified that error appears in the above-identified patent and that said Letters Patent is hereby corrected as shown below:

ON TITLE PAGE: Item [73]

After Assignees, change the name of the second Assignee from "Nakajima Seisakusho Company" to --Nakajima Seisakusho Company Limited--.

Signed and Sealed this

Twenty-eighth Day of April, 1992

*Attest:*

*Attesting Officer*

HARRY F. MANBECK, JR.

*Commissioner of Patents and Trademarks*